US008045865B2

(12) United States Patent
Kamprath

(10) Patent No.: US 8,045,865 B2
(45) Date of Patent: Oct. 25, 2011

(54) AUTOMATIC OPTIMIZATION OF HFSI WARNING THRESHOLDS BASED ON ACTUAL SERVICE INTERVAL STATISTICS

(75) Inventor: David R. Kamprath, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 804 days.

(21) Appl. No.: 12/137,768

(22) Filed: Jun. 12, 2008

(65) Prior Publication Data

US 2009/0309707 A1 Dec. 17, 2009

(51) Int. Cl.
*G03G 15/00* (2006.01)
*G03G 21/00* (2006.01)

(52) U.S. Cl. ..... 399/11; 399/24

(58) Field of Classification Search ..... 399/9, 11, 399/24, 25, 26, 27
See application file for complete search history.

(56) References Cited

U.S. PATENT DOCUMENTS 5,138,377 A * 8/1992 Smith et al. ..... 399/11
6,032,004 A 2/2000 Mirabella, Jr. et al.
2008/0002995 A1* 1/2008 Kamisuwa et al. ..... 399/9 X

* cited by examiner

*Primary Examiner* — Sophia S Chen
(74) *Attorney, Agent, or Firm* — Gibb I.P. Law Firm, LLC

(57) ABSTRACT

If the device-specific maintenance rate statistics is higher than the average maintenance rate statistics, method embodiments herein alter replacement warning thresholds for components of the device by extending the replacement warning thresholds to produce modified replacement warning thresholds. If the specific device incurs unscheduled maintenance visits more often than average, the embodiments herein extend the replacement warning thresholds for components of the device. The amount that the replacement warning thresholds are extended is different for different parts, and is based on part life, part cost, and part service cost. If the device-specific maintenance rate statistics is lower than the average maintenance rate statistics, method embodiments herein alter replacement warning thresholds for components of the device by shortening the replacement warning thresholds to produce modified replacement warning thresholds. If the specific device incurs unscheduled maintenance visits less often than average, the embodiments herein shorten the replacement warning thresholds for components of the device.

20 Claims, 4 Drawing Sheets

AUTOMATIC OPTIMIZATION OF HFSI WARNING THRESHOLDS BASED ON ACTUAL SERVICE INTERVAL STATISTICS

BACKGROUND AND SUMMARY

Embodiments herein generally relate to methods, systems, computer programs, services, etc. for replacing components within complex, heavily used devices that utilize large numbers of individual components to operate properly, such as copiers and printers, where such component replacement systems are based, in part, on the maintenance rate statistics of each specific apparatus.

Within complex, heavily used devices that utilize large numbers of individual components to operate properly, HFSI (High Frequency Service Items) counters are used to provide customer service engineers (CSE's) warnings and replacement directives for parts that wear out at a consistent and predictable interval. HFSI components of a system have a relatively short life with respect to the life of the system. Replacement of such items can result in a large number of unscheduled service calls.

To minimize the number of service calls, devices can track the life of such HFSI components. If the life of a component has exceeded a fixed warning threshold, it is included on a list of components that need to be replaced soon. That list is displayed to the service engineer when they visit the machine, or to the user. If the warning is declared too early, the part is replaced too often resulting in excess parts cost. If the warning is declared too late, the service engineer may not see it before the part fails resulting in an unscheduled service call and the associated additional costs.

One feature of embodiments herein is that each apparatus maintains its own historic interval of service calls and usage, and can alter the warning threshold for part replacement on its own. Thus, in the embodiments herein each device maintains its own device-specific maintenance rate statistics, and each device calculates a device-specific usage amount that will occur before the next predicted maintenance service, based on those device-specific maintenance rate statistics. In other words, each device keeps track of how often maintenance service calls have been performed in the past (e.g., once every 37 days, on average) and each device keeps track of its average usage (e.g., 50,000 copies per month). From this information, each device can determine when the next maintenance service call is likely to occur, and how much usage the device is predicted to undergo before that next predicted maintenance service call occurs.

Then, the embodiments herein can compare the device-specific usage amount that is predicted to occur before the next predicted maintenance service to a predetermined, standard usage amount of a predetermined, standard replacement warning threshold of a component within the device. For example, each component will generally have some recommended standard (predetermined) replacement warning threshold (e.g., 20,000 copies) that is based upon historical averages of that component within many devices. Each individual device can be informed of these standard (predetermined) replacement warning thresholds in a number of ways, including preloading the devices computer storage memory at the time the device is manufactured. In addition, as components are replaced, these standard, predetermined warning thresholds can be updated as the components are made more durable, etc.

If the device-specific usage amount (that is predicted to occur before the next predicted maintenance service, e.g., 25,000 copies) is higher than the predetermined usage amount (that is based on the standard, predetermined warning thresholds, e.g., 15,000 copies), the embodiments herein can alter the replacement warning thresholds for the component by increasing the predetermined warning thresholds to produce modified replacement warning thresholds. Therefore, for example, the standard, predetermined warning threshold could be increased from 15,000 copies to 25,000 copies to provide the warning earlier than it would be provided if the standard warning threshold was utilized.

On the other hand, if the device-specific usage amount (that is predicted to occur before the next predicted maintenance service, e.g., 10,000 copies) is lower than the predetermined usage amount (that is based on the standard, predetermined warning thresholds, e.g., 15,000 copies), the embodiments herein can alter the replacement warning thresholds for the component by decreasing the predetermined warning thresholds to produce modified replacement warning thresholds. Therefore, for example, the standard, predetermined warning threshold could be decreased from 15,000 copies to 10,000 copies to provide the warning later than it would be provided if the standard warning threshold was utilized.

The methods herein store the modified replacement warning thresholds in a computer-readable medium within the device. This storing of the modified replacement warning thresholds can comprise replacing the predetermined replacement warning thresholds with the modified replacement warning thresholds in the computer-readable medium within the device. Therefore, when a query is presented to the device, the device can output component replacement warnings using the modified replacement warning thresholds.

The embodiments herein also comprise machine (apparatus, device, etc.) embodiments. One such embodiment comprises a printing device (of a model type). The printing device includes a computer-readable medium, and a processor operatively connected to the computer-readable medium that executes instructions stored on the computer storage media. Various components are operatively connected to the processor. The processor controls the components to cause the components to print markings on printing media.

At least one counter is operatively connected to the processor, the counter determines (counts) some operating parameter such as the number of prints made by the printing device, the number of hours of operation, the calendar age, etc. Further, this counter (or a different counter) can determine the number of maintenance actions that have been performed on the printing device. The counter stores such counts in the computer-readable medium.

The device includes an input/output (e.g., a graphic user interface, a network connection, a communications port, etc.) that is operatively connected to the processor. The processor calculates device-specific maintenance rate statistics of the printing device based on the maintenance counts, and the processor maintains the device-specific maintenance rate statistics on the computer-readable medium. In other words, the processor maintains its own historic interval of service calls and usage, and can alter the warning threshold for part replacement on its own.

Thus, in the embodiments herein each device maintains its own device-specific maintenance rate statistics, and each processor calculates a device-specific usage amount that will occur before the next predicted maintenance service, based on those device-specific maintenance rate statistics. In other words, each processor keeps track of how often maintenance service calls have been performed in the past and each processor keeps track of its average usage. From this information, each processor can determine when the next maintenance service call is likely to occur, and how much usage the device is predicted to undergo before that next predicted maintenance service call occurs.

Then, the processor can compare the device-specific usage amount that is predicted to occur before the next predicted maintenance service to a predetermined, standard usage amount of a predetermined, standard replacement warning threshold of a component within the device. Each individual device can be informed of these standard (predetermined) replacement warning thresholds in a number of ways, including preloading the computer storage memory at the time the device is manufactured. In addition, as components are replaced, these standard, predetermined warning thresholds can be updated as the components are made more durable, etc.

If the device-specific usage amount is higher than the predetermined usage amount, the processor can alter the replacement warning thresholds for the component by increasing the predetermined warning thresholds to produce modified replacement warning thresholds. Similarly, if the device-specific usage amount is lower than the predetermined usage amount, the processor can alter the replacement warning thresholds for the component by decreasing the predetermined warning thresholds to produce modified replacement warning thresholds.

Whether the warning thresholds are increased or decreased, the processor stores the modified replacement warning thresholds in a computer-readable medium within the device. When storing the modified replacement warning thresholds, the processor can replace previous (or standard) warning thresholds with the modified replacement warning thresholds in the computer-readable medium of the device. This allows the device to provide automated warnings regarding the need for part replacement. In addition, in response to a query presented to the device, the processor can output component replacement warnings using the modified replacement warning thresholds.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Certain parts in any complex device have very predictable failure rates and are critical to the reliability/function of the system. These are called HFSI's (High Frequency Service Items). Typical examples in printing devices are fuser rolls, photoreceptor belts, rolls etc. These parts are listed in a screen on the user interface each time a CSE makes a service call. The current age (based on the part's usage meter) of the component is displayed. Components that are nearing the end of their useful life can be highlighted in some manner (e.g., colored yellow (warning)) and those that have reached the expected end of their useful life can also be marked in some other manner (e.g., colored red). Service engineers are usually directed to replace those colored red, while the replacement of those colored yellow are left to the discretion of the service engineer.

With embodiments herein, the system calculates the warning threshold for HFSI component replacement (the count above which one of the warning indicators will be displayed) based on the actual history of service call frequency for that specific system. The systems and methods herein track the interval between service calls in terms of the units used to track the HFSI life. The embodiments herein can determine the average and distribution over the life of the system or can calculate a running average and distribution over the most recent time period. These statistics, together with fixed part life and cost data, are used by the embodiments herein to calculate an altered or revised HFSI warning threshold (potentially in real time) whenever the list of components to be replaced soon is requested. The embodiment provides minimum service costs for HFSI components on each individual system.

Figure 1:
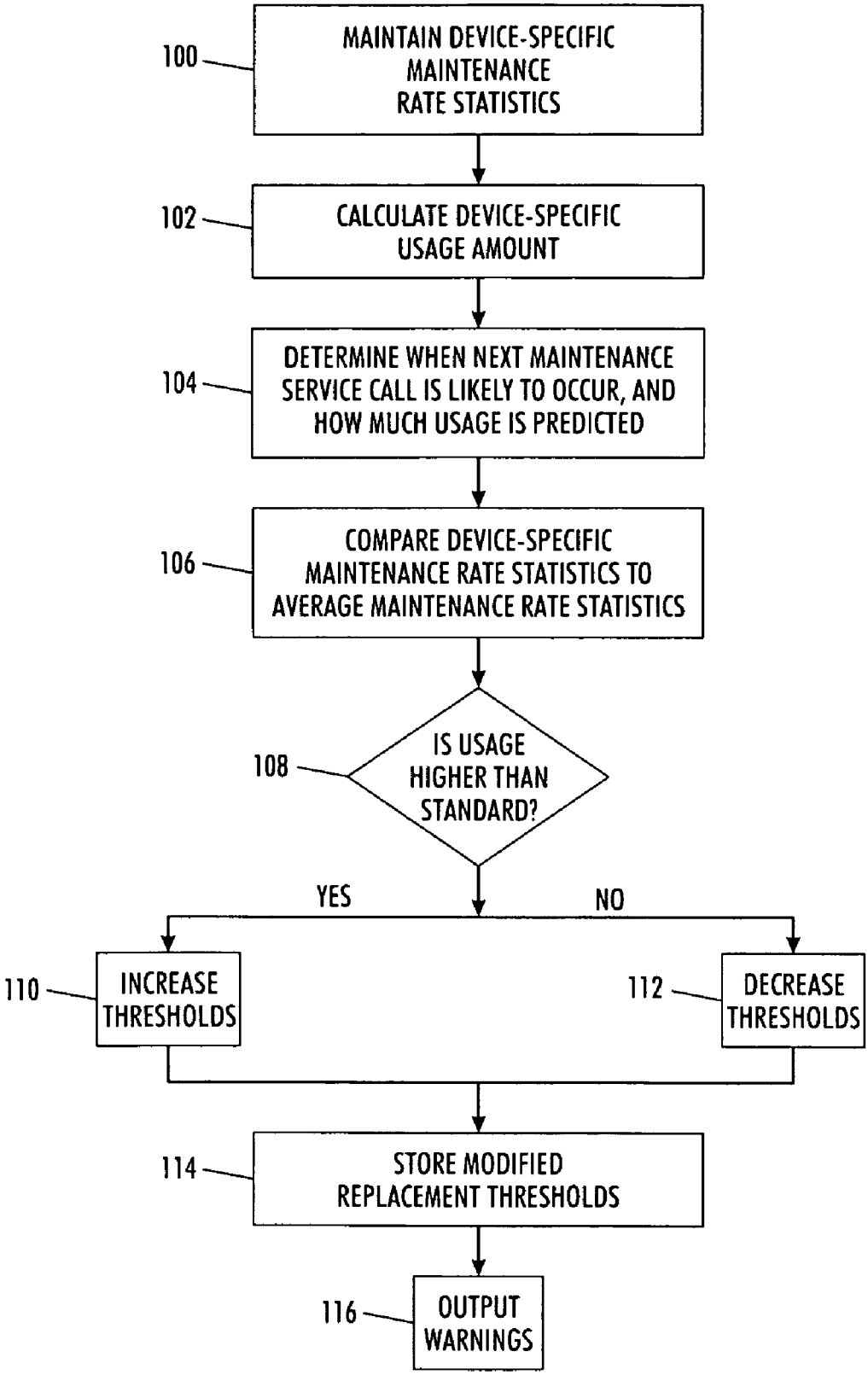
FIG. 1 is a flow diagram illustrating embodiments herein.

One exemplary method is shown in flowchart form in FIG. 1. In the embodiments herein each device maintains its own device-specific maintenance rate statistics (100), and each device calculates a device-specific usage amount that will occur before the next predicted maintenance service (102), based on those device-specific maintenance rate statistics. In other words, each device keeps track of how often maintenance service calls have been performed in the past (e.g., once every 37 days, on average) and each device keeps track of its average usage (e.g., 50,000 copies per month). From this information, each device can determine when the next maintenance service call is likely to occur (104) and how much usage the device is predicted to undergo before that next predicted maintenance service call occurs (106).

Then, the embodiments herein can compare the device-specific usage amount that is predicted to occur before the next predicted maintenance service to a predetermined, standard usage amount of a predetermined, standard replacement warning threshold of a component within the device (108). For example, each component will generally have some recommended standard (predetermined) replacement warning threshold (e.g., 20,000 copies) that is based upon historical averages of that component within many devices. Each individual device can be informed of these standard (predetermined) replacement warning thresholds in a number of ways, including preloading the devices computer storage memory at the time the device is manufactured. In addition, as components are replaced, these standard, predetermined warning thresholds can be updated as the components are made more durable, etc.

If the device-specific usage amount (that is predicted to occur before the next predicted maintenance service, e.g., 25,000 copies) is higher than the predetermined usage amount (that is based on the standard, predetermined warning thresholds, e.g., 15,000 copies), the embodiments herein can alter the replacement warning thresholds for the component by increasing the predetermined warning thresholds to produce modified replacement warning thresholds (110). Therefore, for example, the standard, predetermined warning threshold could be increased from 15,000 copies to 25,000 copies to provide the warning earlier than it would be provided if the standard warning threshold was utilized.

On the other hand, if the device-specific usage amount (that is predicted to occur before the next predicted maintenance service, e.g., 10,000 copies) is lower than the predetermined usage amount (that is based on the standard, predetermined warning thresholds, e.g., 15,000 copies), the embodiments herein can alter the replacement warning thresholds for the component by decreasing the predetermined warning thresholds to produce modified replacement warning thresholds (112). Therefore, for example, the standard, predetermined warning threshold could be decreased from 15,000 copies to 10,000 copies to provide the warning later than it would be provided if the standard warning threshold was utilized.

The methods herein store the modified replacement warning thresholds in a computer-readable medium within the device (114). This storing of the modified replacement warning thresholds can comprise replacing the predetermined replacement warning thresholds with the modified replacement warning thresholds in the computer-readable medium within the device. Therefore, when a query is presented to the device, the device can output component replacement warnings using the modified replacement warning thresholds (116).

Figure 2:
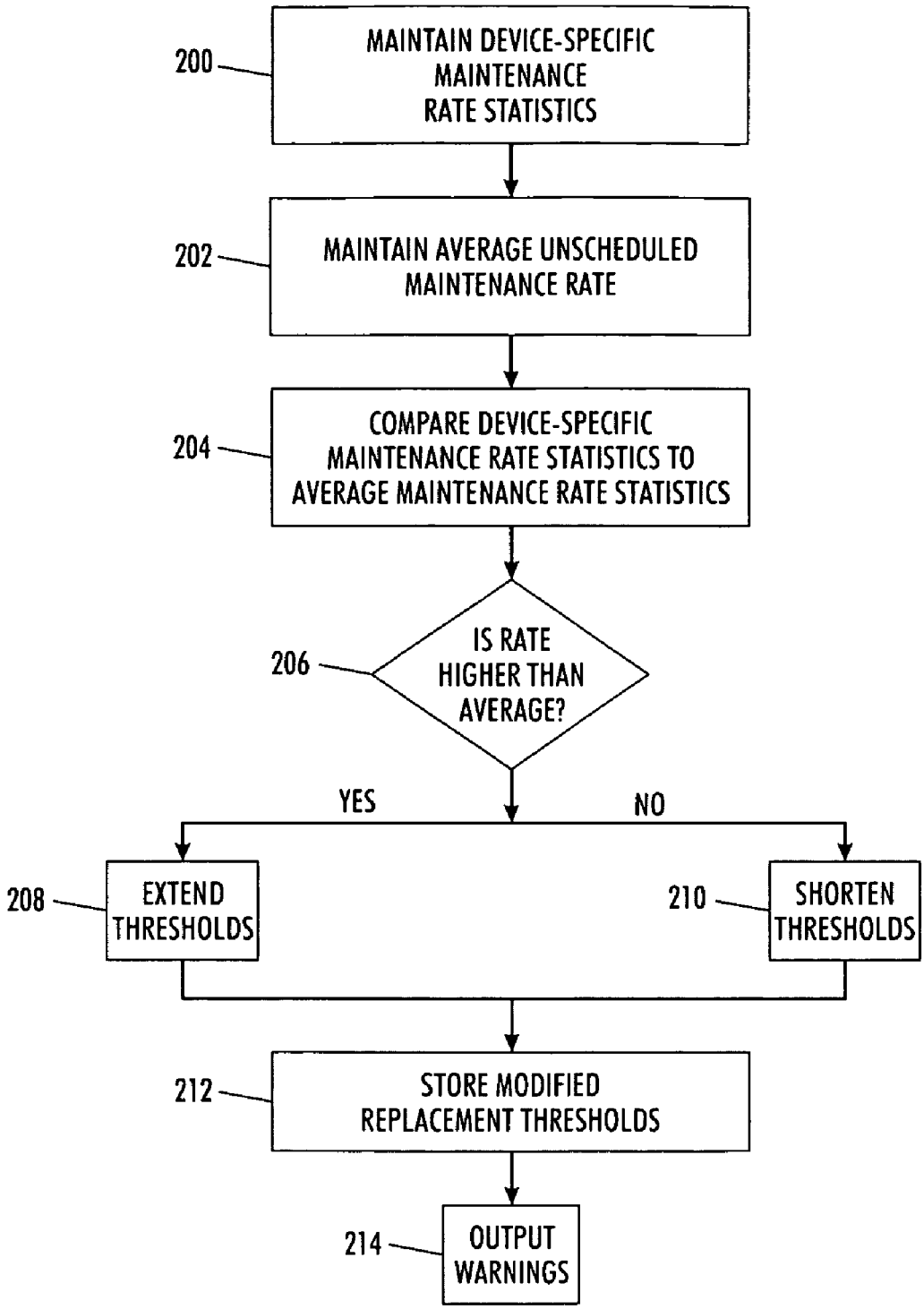
FIG. 2 is a flow diagram illustrating embodiments herein.

Another exemplary embodiment is shown in FIG. 2. In item 200, this method maintains device-specific maintenance rate statistics of the device and, in item 202, the method maintains the average maintenance rate statistics of all devices of the model type. As shown in item 204, the method embodiments herein compare the device-specific maintenance rate statistics to the average maintenance rate statistics.

If the device-specific maintenance rate statistics is higher than the average maintenance rate statistics (item 206), method embodiments herein alter replacement warning thresholds for components of the device by extending the replacement warning thresholds to produce modified replacement warning thresholds (item 208). In other words, if the specific device incurs unscheduled maintenance visits more often than average, the embodiments herein extend the replacement warning thresholds for components of the device. The amount that the replacement warning thresholds are extended is different for different parts, and is based on part life, part cost, and part service cost, as explained in greater detail below with respect to FIG. 3.

If the device-specific maintenance rate statistics is lower than the average maintenance rate statistics (item 206), method embodiments herein alter replacement warning thresholds for components of the device by shortening the replacement warning thresholds to produce modified replacement warning thresholds (item 210). In other words, if the specific device incurs unscheduled maintenance visits less often than average, the embodiments herein shorten the replacement warning thresholds for components of the device. The amount that the replacement warning thresholds are shortened is different for different parts, and is based on part life, part cost, and part service cost, as explained in greater detail below with respect to FIG. 3.

Whether the warning thresholds are increased or decreased, the method stores the modified replacement warning thresholds in a computer-readable medium within the device in item 212. When storing the modified replacement warning thresholds 212, the methods herein can replace previous (or standard) warning thresholds with the modified replacement warning thresholds in the computer-readable medium of the device. This allows the device to provide automated warnings regarding the need for part replacement. In addition, in response to a query presented to the device, the device can output component replacement warnings in item 214 using the modified replacement warning thresholds.

One of the features of the embodiments herein is that each of the individual devices can autonomously maintain the device-specific maintenance rate statistics and can autonomously compare the device-specific maintenance rate statistics to the average maintenance rate statistics (potentially periodically). The average unscheduled maintenance is maintained outside the device and is supplied to the device either once during manufacturing or periodically throughout the device's lifespan.

A number of different classifications can be utilized to determine how to calculate the average maintenance rate statistics. For example, the average maintenance rate statistics of all similar type devices can be used (e.g., all copiers) or the average can be based on all devices of the same class of model (e.g., 5000 series copiers). Also, if there are enough devices available, the average unscheduled maintenance can be based upon a single model and even model month, model year, etc. (e.g., 5123 series copiers manufactured in May of 2006).

In general, the warning thresholds will be calculated as follows. If the interval between service calls is smaller than average (frequent service calls) then the warning threshold will be adjusted to present a warning later than average to minimize part usage. If the interval between service calls is larger than average (infrequent service calls) then the warning threshold will also be adjusted to present a warning earlier than average to minimize unscheduled service calls.

Many different methods can be used to determine how much the thresholds should be shortened or extended. For example, each of the thresholds could be simply altered by some predetermined percentage (e.g., 5%, 10%, 25%, etc.). Alternatively, the change to the thresholds could correspond to the amount by which the device-specific maintenance rate statistics varies from the average maintenance rate statistics. Thus, if the device specific rate were 15% above or below the average rate, the threshold could be shortened or extended by 15% (or some multiple of 15%).

Alternatively, more sophisticated methodologies can be used. Equations may be developed that specify the component replacement warning thresholds as a function of device-specific maintenance rate statistics. Such equations may be formulated to achieve minimum total service cost using known mathematical techniques. They may take into account factors that influence the total service cost such as part life statistics, part cost, service time, and service labor rate. This would allow different warning threshold adjustments to be made for different components within the device. One example of a specific method that is based on different variables is discussed below and shown graphically in FIG. 3. In this example, the calculation can be determined using data on part life, part cost, and service cost information. The example shown is for a fuser web cassette; however, as would be understood by one ordinarily skilled in the art, the calculation can take different forms to accommodate the data available for the component of interest.

Figure 3:
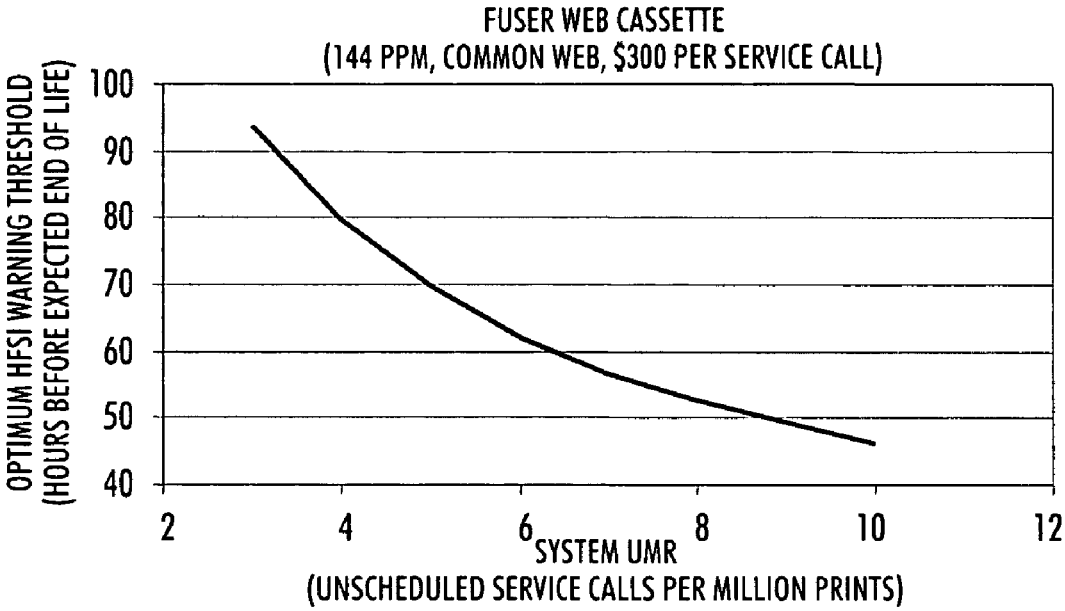
FIG. 3 is chart illustrating how the warning threshold can be changed for a given device.

In this example, the Warning Threshold=$k1*UMR^3+k2*UMR^2+k3*UMR+k4$. In this calculation, UMR is the average maintenance rate statistics and the constants (k) are selected to weight the UMR according to specific details of part life, part cost, part service cost, as well as other consideration factors. In this specific calculation, k1=−1.17E−01; k2=3.19E+00; k3=−3.19E+01; and k4=1.64E+02. UMR is the inverse of interval between service calls. once again, miscalculation and its graphic representation shown in FIG. 3 are only an example relating to a fuser web cassette and the calculation would be different for a different component and would be different if different factors were considered other than the part of life, the part cost, the Park service costs, etc. Therefore, the embodiments herein are not limited to the specific example shown in FIG. 3.

Figure 4:
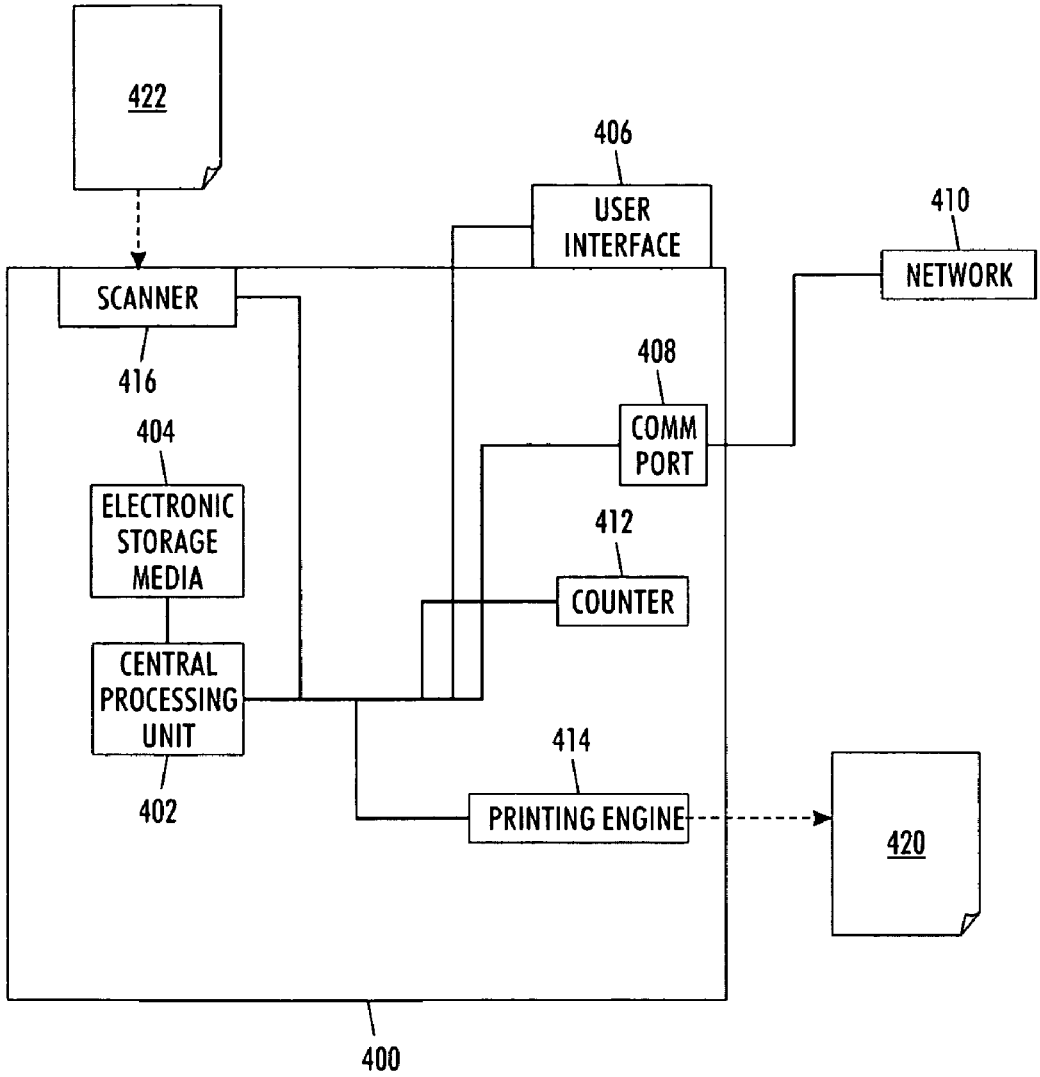
FIG. 4 is a cross-sectional schematic representation of an apparatus embodiment herein.

As shown in FIG. 4, the embodiments herein also comprise machine (apparatus, device, etc.) embodiments. One such embodiment comprises a specific model type of a multi-function printing device 400. The printing device 400 can include a computer-readable medium (e.g., electronic storage media 404), and a processor 402 operatively connected to the computer-readable medium 404 and executing instructions stored on the computer storage media. Various components are operatively connected to the processor such as a printing engine 414 that can print markings on print media 420, and a scanner 416 that can scan images of a document 422. The processor 402 controls the components to cause the components to print markings on printing media 420.

At least one counter 412 is operatively connected to the processor, the counter 412 determines (counts) some operating parameter such as the number of prints made by the printing device, the number of hours of operation, the calendar age, etc. Further, this counter 412 (or a different counter) can determine the number of maintenance actions that have been performed on the printing device. The counter 412 stores such counts in the computer-readable medium 404.

The device includes at least one input/output (e.g., a graphic user interface 406, a network connection/communications port 408 capable of communicating with an external network 410, etc.) that is operatively connected to the processor 402.

The processor 402 calculates device-specific maintenance rate statistics of the printing device based on the maintenance counts, and the processor 402 maintains the device-specific maintenance rate statistics on the computer-readable medium. In other words, the processor 402 maintains its own historic interval of service calls and usage, and can alter the warning threshold for part replacement on its own.

Thus, in the embodiments herein each device maintains its own device-specific maintenance rate statistics, and each processor 402 calculates a device-specific usage amount that will occur before the next predicted maintenance service, based on those device-specific maintenance rate statistics. In other words, each processor 402 keeps track of how often maintenance service calls have been performed in the past and each processor 402 keeps track of its average usage. From this information, each processor 402 can determine when the next maintenance service call is likely to occur, and how much usage the device is predicted to undergo before that next predicted maintenance service call occurs.

Then, the processor 402 can compare the device-specific usage amount that is predicted to occur before the next predicted maintenance service to a predetermined, standard usage amount of a predetermined, standard replacement warning threshold of a component within the device. Each individual device can be informed of these standard (predetermined) replacement warning thresholds in a number of ways, including preloading the computer storage memory at the time the device is manufactured. In addition, as components are replaced, these standard, predetermined warning thresholds can be updated as the components are made more durable, etc.

If the device-specific usage amount is higher than the predetermined usage amount, the processor 402 can alter the replacement warning thresholds for the component by increasing the predetermined warning thresholds to produce modified replacement warning thresholds. Similarly, if the device-specific usage amount is lower than the predetermined usage amount, the processor 402 can alter the replacement warning thresholds for the component by decreasing the predetermined warning thresholds to produce modified replacement warning thresholds.

Whether the warning thresholds are increased or decreased, the processor 402 stores the modified replacement warning thresholds in a computer-readable medium within the device. When storing the modified replacement warning thresholds, the processor 402 can replace previous (or standard) warning thresholds with the modified replacement warning thresholds in the computer-readable medium of the device. This allows the device to provide automated warnings regarding the need for part replacement. In addition, in response to a query presented to the device, the processor 402 can output component replacement warnings using the modified replacement warning thresholds.

In an alternative embodiment, the processor 402 calculates device-specific maintenance rate statistics of the printing device based on the unscheduled maintenance counts from the counter 412. The processor 402 maintains the device-specific maintenance rate statistics on the computer-readable medium 404. As mentioned above, the processor 402 compares the device-specific maintenance rate statistics to the average maintenance rate statistics.

If the device-specific maintenance rate statistics is higher than the average maintenance rate statistics, the processor 402 alters replacement warning thresholds for components of the device by extending the replacement warning thresholds to produce modified replacement warning thresholds. In other words, if the specific device incurs unscheduled maintenance visits more often than average, the embodiments herein extend the replacement warning thresholds for components of the device. The amount that the replacement warning thresholds are extended is different for different parts, and is based on part life, part cost, and part service cost.

If the device-specific maintenance rate statistics is lower than the average maintenance rate statistics, the processor 402 alters replacement warning thresholds for components of the device by shortening the replacement warning thresholds to produce modified replacement warning thresholds. In other words, if the specific device incurs unscheduled maintenance visits less often than average, the embodiments herein shorten the replacement warning thresholds for components of the device. The amount that the replacement warning thresholds are shortened is different for different parts, and is based on part life, part cost, and part service cost.

Whether the warning thresholds are increased or decreased, the processor 402 stores the modified replacement warning thresholds in a computer-readable medium 404 within the device. When storing the modified replacement warning thresholds, the processor 402 can replace previous (or standard) warning thresholds with the modified replacement warning thresholds in the computer-readable medium 404 of the device. This allows the device to provide automated warnings regarding the need for part replacement. In addition, in response to a query presented to the device, the processor 402 can output component replacement warnings using the modified replacement warning thresholds.

One of the features of the embodiments herein is that each of the individual devices can autonomously maintain the device-specific maintenance rate statistics and can autonomously compare the device-specific maintenance rate statistics to the average maintenance rate statistics (potentially periodically). The average maintenance rate statistics is maintained outside the device and is supplied to the device either once during manufacturing or periodically throughout the device's lifespan using the input/output.

Many computerized devices and printers are discussed above. Many forms of printing devices are currently available from manufactures such as Xerox Corporation, Norwalk, Conn., USA. Computerized devices that include chip-based central processing units (CPU's), input/output devices (including graphic user interfaces (GUI), memories, comparators, processors, etc. are well-known and readily available devices produced by manufactures such as International Business Machines Corporation, Armonk N.Y., USA and Apple Computer Co., Cupertino Calif., USA. Such computerized devices and printers commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and Visioneer, Inc. Pleasanton, Calif., USA and the details of such devices are not discussed herein for purposes of brevity and reader focus.

The words printer, printing device, output device, etc., as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the invention should not be implied or imported from any above example as limitations to any particular order, number, position, size, shape, angle, color, or material.

What is claimed is:

1. A method comprising:

maintaining device-specific maintenance rate statistics of a device;

calculating a device-specific usage amount that will occur before a next predicted maintenance service, based on said device-specific maintenance rate statistics of said device;

comparing said device-specific usage amount that will occur before said next predicted maintenance service to a predetermined usage amount of a predetermined replacement warning threshold of a component within said device;

if said device-specific usage amount is higher than said predetermined usage amount, altering replacement warning thresholds for said component by increasing said predetermined warning thresholds to produce modified replacement warning thresholds;

if said device-specific usage amount is lower than said predetermined usage amount, altering replacement warning thresholds for said component by decreasing said predetermined warning thresholds to produce modified replacement warning thresholds;

storing said modified replacement warning thresholds in a computer-readable medium within said device; and in response to a query presented to said device, outputting, from said device, component replacement warnings using said modified replacement warning thresholds.

2. The method according to claim 1, said storing of said modified replacement warning thresholds comprising replacing said predetermined replacement warning thresholds with said modified replacement warning thresholds in said computer-readable medium within said device.

3. The method according to claim 1, said maintaining and said comparing being performed by said device.

4. The method according to claim 1, further comprising supplying said predetermined usage amount to said device.

5. The method according to claim 1, said maintaining of said device-specific maintenance rate statistics comprising determining a rate at which maintenance services are periodically performed on said device.

6. A method comprising:

maintaining device-specific maintenance rate statistics of a device, said device being of a model type;

maintaining an average maintenance rate statistics of all devices of said model type;

comparing said device-specific maintenance rate statistics to said average maintenance rate statistics;

if said device-specific maintenance rate statistics is higher than said average maintenance rate statistics, altering replacement warning thresholds for components of said device by extending said replacement warning thresholds to produce modified replacement warning thresholds;

if said device-specific maintenance rate statistics is lower than said average maintenance rate statistics, altering replacement warning thresholds for components of said device by shortening said replacement warning thresholds to produce said modified replacement warning thresholds;

storing said modified replacement warning thresholds in a computer-readable medium within said device; and in response to a query presented to said device, outputting, from said device, component replacement warnings using said modified replacement warning thresholds.

7. The method according to claim 6, said storing of said modified replacement warning thresholds comprising replacing previous replacement warning thresholds with said modified replacement warning thresholds in said computer-readable medium within said device.

8. The method according to claim 6, said maintaining of said device-specific maintenance rate statistics and said comparing of said device-specific maintenance rate statistics to said average maintenance rate statistics being performed by said device.

9. The method according to claim 8, further comprising supplying an average unscheduled maintenance to said device.

10. The method according to claim 6, said device and said devices one of:

all have the same model number; and are all of the same model class.

11. A computer program product comprising:

a computer-readable data carrier storing instructions that, when executed by a computer, cause the computer to perform a method comprising:

maintaining device-specific maintenance rate statistics of a device;

calculating a device-specific usage amount that will occur before a next predicted maintenance service, based on said device-specific maintenance rate statistics of said device;

comparing said device-specific usage amount that will occur before said next predicted maintenance service to a predetermined usage amount of a predetermined replacement warning threshold of a component within said device;

if said device-specific usage amount is higher than said predetermined usage amount, altering replacement warning thresholds for said component by increasing said predetermined warning thresholds to produce modified replacement warning thresholds;

if said device-specific usage amount is lower than said predetermined usage amount, altering replacement warning thresholds for said component by decreasing said predetermined warning thresholds to produce modified replacement warning thresholds;

storing said modified replacement warning thresholds in a computer-readable medium within said device; and in response to a query presented to said device, outputting, from said device, component replacement warnings using said modified replacement warning thresholds.

12. The computer program product according to claim 11, said storing of said modified replacement warning thresholds comprising replacing said predetermined replacement warning thresholds with said modified replacement warning thresholds in said computer-readable medium within said device.

13. The computer program product according to claim 11, said maintaining and said comparing being performed by said device.

14. The computer program product according to claim 11, further comprising supplying said predetermined usage amount to said device.

15. The computer program product according to claim 11, said maintaining of said device-specific maintenance rate statistics comprising determining a rate at which maintenance services are periodically performed on said device.

16. A printing device of a model type, said printing device comprising:

a computer-readable medium;

a processor operatively connected to said computer-readable medium and executing instructions stored on said computer storage media;

components operatively connected to said processor, said processor controlling said components to cause said components to print markings on printing media, at least one counter operatively connected to said processor, said counter determining a number of prints made by said printing device and counting a number of maintenance actions performed on said printing device, and said counter storing device-specific maintenance rate statistics in said computer-readable medium; and an input/output operatively connected to said processor, said processor calculating a device-specific usage amount that will occur before a next predicted maintenance service, based on said device-specific maintenance rate statistics;

said processor comparing said device-specific usage amount that will occur before said next predicted maintenance service to a predetermined usage amount of a predetermined replacement warning threshold of a component within said device;

if said device-specific usage amount is higher than said predetermined usage amount, said processor alters replacement warning thresholds for said component by increasing said predetermined warning thresholds to produce modified replacement warning thresholds;

if said device-specific usage amount is lower than said predetermined usage amount, said processor alters replacement warning thresholds for said component by decreasing said predetermined warning thresholds to produce modified replacement warning thresholds;

said processor storing said modified replacement warning thresholds in said computer-readable medium; and in response to a query presented to said device, said processor outputs component replacement warnings using said modified replacement warning thresholds.

17. The printing device according to claim 16, said processor storing said modified replacement warning thresholds by replacing said predetermined replacement warning thresholds with said modified replacement warning thresholds in said computer-readable medium within said device.

18. The printing device according to claim 16, said computer-readable medium storing said predetermined usage amount.

19. The printing device according to claim 16, said processor determining a rate at which maintenance services are periodically performed on said device.

20. The printing device according to claim 16, said printing device comprising one of an electrostatographic device and a xerographic device.

* * * * *